United States Patent [19]

DeCloux

[11] Patent Number: 4,685,669

[45] **Date of Patent: * Aug. 11, 1987**

[54] DESCENT SPEED CONTROL FOR EXERCISE STAIR

[76] Inventor: Richard J. DeCloux, 1485 Belmont St., Manchester, N.H. 03104

[ * ] Notice: The portion of the term of this patent subsequent to Oct. 16, 2001 has been disclaimed.

[21] Appl. No.: 636,908

[22] Filed: Aug. 2, 1984

[51] Int. Cl.[4] ..... A63B 21/00

[52] U.S. Cl. ..... 272/130; 272/70

[58] Field of Search ..... 272/69, 70, 130, 134, 272/72; 91/520; 73/379; 128/25 R

[56] References Cited

U.S. PATENT DOCUMENTS

| | | | |
|---|---|---|---|
| 2,079,594 | 5/1937 | Clem | 128/25 R |
| 3,529,474 | 9/1970 | Olson et al. | 73/379 |
| 3,530,766 | 9/1970 | Pilch | 91/520 |
| 3,970,302 | 7/1976 | McFee | 272/130 |
| 4,063,726 | 12/1977 | Wilson | 272/130 |
| 4,241,641 | 12/1980 | Reinert | 91/520 |
| 4,477,072 | 10/1984 | DeCloux | 272/73 |
| 4,496,147 | 1/1985 | DeCloux et al. | 272/70 |
| 4,519,603 | 5/1985 | DeCloux | 272/73 |

*Primary Examiner*—Richard J. Apley
*Assistant Examiner*—S. R. Crow
*Attorney, Agent, or Firm*—Weingarten, Schurgin, Gagnebin & Hayes

[57] ABSTRACT

Apparatus that controls the cycle rate of various incline or stair-climbing simulation exercise machines in a non-linear fashion so that the downward step movement is slowed appropriately during portions of its travel to facilitate cyclic "step-up" i.e., raising of the user's center of gravity; this slowing occurring during the uppermost portion of the step's descent (and/or the lowermost portion in some cases) while the rest of the descent is made at higher speed; including a pair of hydraulic cylinders serving as a means of coupling the steps together and dissipating the energy transmitted by the user, the flow of fluid between the cylinders being controlled during the step descent by variable orifices controlled by cams or a cam/switch/solenoid system.

19 Claims, 2 Drawing Figures

DESCENT SPEED CONTROL FOR EXERCISE STAIR

FIELD OF INVENTION

This invention relates to exercise devices and more particularly to a hydraulic system for simulated stair or incline climbing that absorbs and dissipates user's energy input, and controls the related exercise parameters of force, rate, and length of stroke.

BACKGROUND OF THE INVENTION

Present incline or stair-climbing exercise art teaches a constant rate of descent of the downward moving step under weight of the user. These teachings are best elucidated by U.S. Pat. Nos. 3,592,466; 3,529,474; and 3,970,302 issued respectively to Parson, Olson and McFee. They do not provide for a slowing of a portion of the downward step movement to facilitate "step-up", and as a result, lose a portion of the advantage that stair or incline climbing has in comparison with other exercises. This lost advantage is important, becoming larger and more important as the exercise intensity level increases with increased stepping rate or frequency.

The advantage obtained by exercising through climbing an incline as opposed to moving on a level surface is that on the incline greater energy expenditure rates can be obtained with less velocity. Research on energy expenditure rates for walking/running on the level and on an lincline has produced the Bobbert equation:

$$\text{Log}_{10}H=\text{Log}_{10}W \quad 0.004591V+0.024487\theta+0.0002659\,V\theta$$

By examination of this formula that relates energy expended (H) with body weight (W), velocity (V), clamping angle ($\theta$), it can be seen when the climbing angle is zero, the velocity required for any significant energy expenditure is higher than when the slope ($\theta$) is positive.

This velocity reduction when exercising on an incline is turned into comfort by stair-climbing exercise equipment, allowing uses to exercise at higher levels for shorter periods of time. However, in observing exercisers using existing stair-climbing simulation equipment at various climbing rates, and in reviewing resulting physiological indicators such as oxygen consumption, it is noticeable that the amount of vertical displacement of the user's center of gravity (c.g.) in respect to the earth that occurs with each step is decreased as the stepping rate (velocity) is increased. At very low stepping rates the displacement of the user's c.g. is essentially that of the height difference between the lowest position of the step and its highest position. At very high stepping rates, the user's c.g. displacement is near zero. Moreover, the rate of oxygen consumed, which is the accepted index of exercise cardio-vascular benefit drops in relation to the stepping rate.

In walking or running on an incline, the activity that the subject equipment is simulating, it is noticeable that the amount of vertical displacement of the exerciser's c.g. it not effected by his climbing rate. By walking or running 100 feet along a slope of 35° he will raise c.g. 57 feet no matter how fast he moves. Moreover, his rate of oxygen consumption (which is the measure of energy output) will (according to the Bobbert equation expressing observed data) follow quite closely his stepping rate (velocity).

In order to have stair-climbing simulation equipment more closely produce the exercise results of actual slope climbing, and thereby obtain the benefits associated with the higher energy outputs at lower speeds (the inherent exercise advantage associated with climbing in comparison with other exercises) it is desireable to make the user's c.g. displacement less effected by the stepping rate than it is now in current equipment.

SUMMARY OF THE INVENTION

It is thus a feature of the subject invention that the vertical c.g. displacement of exercisers using stair-climbing simulation equipment can be made less sensitive to stepping rate by making stair-climbing simulation equipment that segements the downward travel of the weight bearing step, and controls the rate of descent so that a relatively slow descent during the uppermost portion of the downward step travel (and in some instances, the lower most portion along or in combination with the uppermost) provides a firmer platform for step-up, and so that a relatively fast descent for the rest of the step movement preserves a high stepping rate. In other words, a high stepping rate ordinarily does not provide a firm upper step upon which to step. By providing the nonlinear system described, a firmer upper step is provided.

By way of example, the descent rate control for simulated stair-climbing exercise equipment is often incorporated in the device that converts the user's energy input into heat (friction surfaces, fluid expansion orifices, etc.). These devices can be keyed to the position of the steps, and controlled to effect the step descent rate in the desired fashion.

In the case of a hydraulic system which controls the rate of descent by a variable orifice, the desired segmentation and relative rates of descent can be obtained by the addition of a second variable orifice in parallel with the first, that second orifice being keyed to be open, by cams or a cam/switch/solenoid system during that portion of the descent that is desired to be fast, and closed during the "step-up" portion of the descent which is desired to be slow.

The same effect can be achieved with a single orifice (valve) by adjusting the size of the orifice, or modulating the open time, during the step descent. In friction systems similar control is available with cams, or cam/-switch/solenoid systems.

BRIEF DESCRIPTION OF THE DRAWINGS

These and other features of the subject invention will be better understood in connection with the detailed description taken in conjunction with the drawings of which

DETAILED DESCRIPTION OF THE INVENTION

Figure 1:
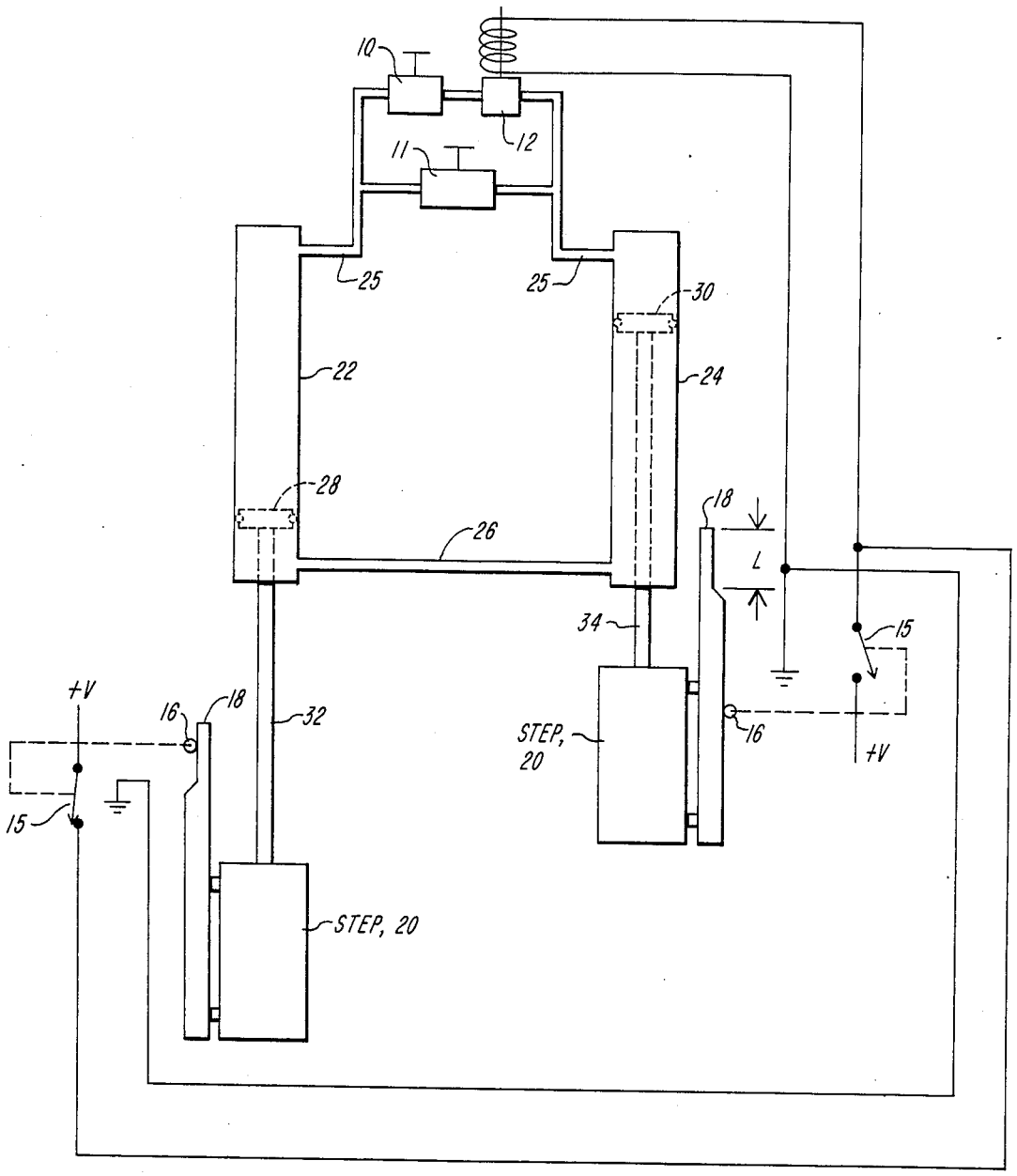
FIG. 1 is a schematic illustration of a hyraulic control system for utilization with stair-climbing apparatus.

FIG. 1 shows a stair-climbing hydraulic control system having the addition of a variable orifice 10 in parallel with an exercise intensity climbing rate control valve 11. A solenoid controlled on/off valve 12 is provided in series with valve 10, with the valves being connected between double-acting cylinders 22 and 24, via conduits 25, with conduits 25 running between the cylinder portions above pistons 28 and 30, and with conduit 26 running between the respective cylinders below the respective pistons. Two cam follower actuated switches 15 are provided adjacent cam followers 16 which ride on cams 18 that are attached to the steps 20 and move with the steps. The solenoid on/off valve 12 is normally open.

It will be appreciated that the system illustrated in FIG. 1 is a closed hydraulic system in which the fluid in double-acting hydraulic cylinders 22 and 24 exists above and below pistons 28 and 30 which have rods 32 and 34 respectively secured at their ends to steps 20. As such the apparatus shown in FIG. 1 constitutes a phasing system 35 for steps 20. These steps are secured in respective tracks so as to be able to translate in a side by side arrangement to facilitate the stair-climbing.

It will be appreciated that the aforementioned solenoid operation produces a nonlinear step movement to facilitate step up at the appropriate time.

Figure 2:
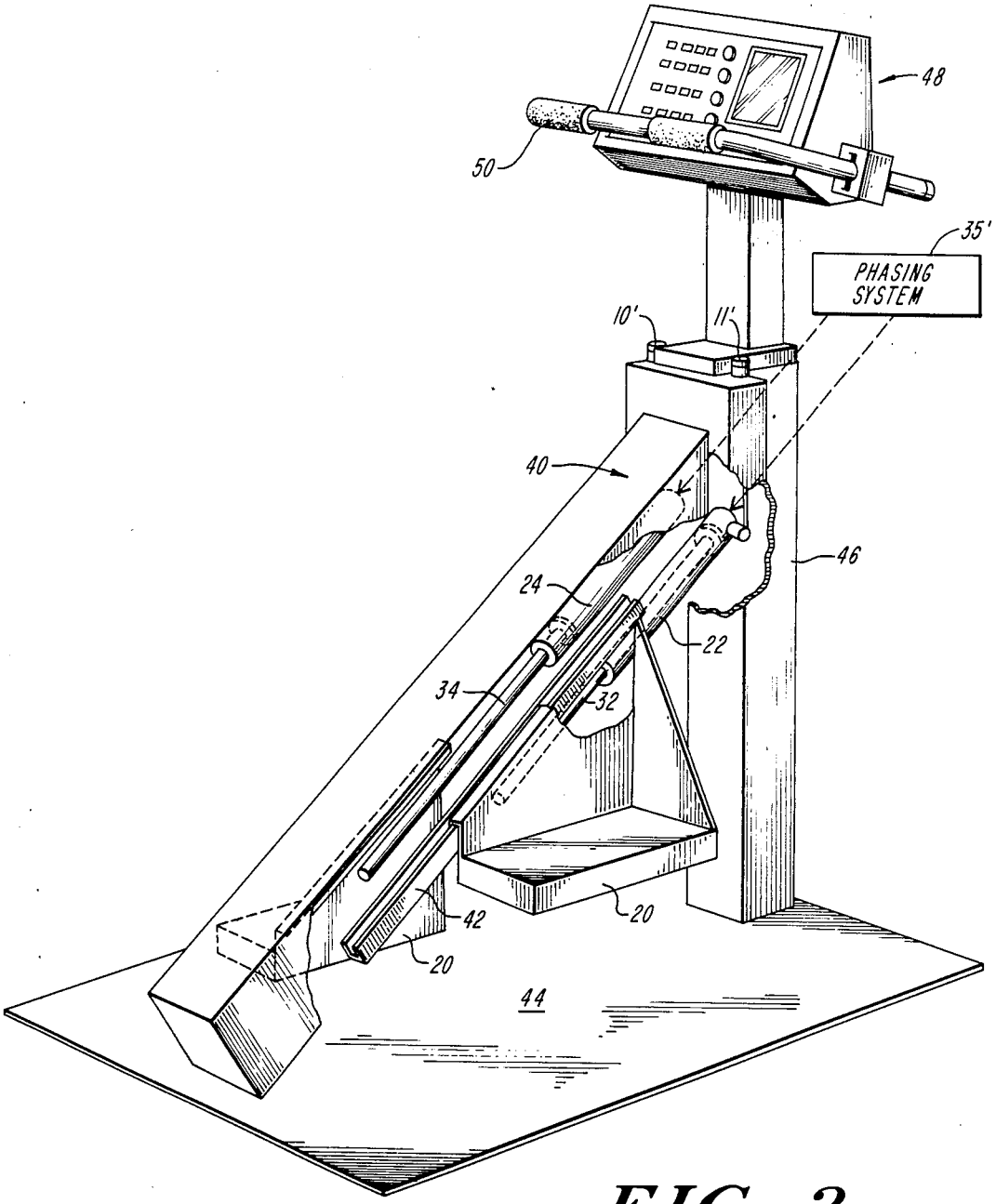
FIG. 2 is a diagramatic representation of the utilization of the hydraulic control system of FIG. 1 for use in the stair-climbing apparatus illustrated in FIG. 2.

Referring now to FIG. 2 it will be appreciated how the hydraulic cylinders are attached to steps 20. Note that these steps move along an inclined plane with steps 20 being mounted to a frame 40 via tracks 42. Frame 40 has a base 44 and a verticle member 46 to which is attached a display and control console 48, having a handle bar 50 slideably attached thereto. Hydraulic cylinders 22 and 24 are mounted to the upper part of the frame and secured within tracks 42 within the sloping portion of the frame. Here phasing system $35^1$ corresponds to phasing system 35 of FIG. 1.

It will be appreciated that the subject system, which provides for increased resistance during a step-up portion of the exercise cycle is particularly useful for fast climbing rates. As such the subject device is extremely useful for those individuals who are in better than average shape so that they can increase their stepping rate and therefore their exercise rate.

In operation, when one of the two steps approaches bottom, it causes the cam follower to drop on the cam which in turn closes the associated switch which in turn powers the normally open off/on valve to close. This reduces the fluid flow through the combined paths of the main climbing rate control valve 11, with the parallel valve 12 modulating flow to provide slowing appropriately. The length L of the dropped portion of the cam determines how much of the stroke, in this case both at the top and bottom of the step travel, will be slowed.

It will be appreciated that while the foregoing description has been concerned with an electromechanical system utilizing a cam operated switch and solenoid, the subject invention could also be utilized with a solely mechanical cam-operated system for opening and closing the valve for providing the step-up function.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A simulated stair-climbing device, comprising:

a frame;

a pair of footrests;

means for mounting the pair of footrests to the frame for reciprocating motion respectively along first and second, generally parallel, linear paths each path having first and second terminal points;

means for sensing the position of the footrests along their respective linear paths; and variable impedance means acting in response to said position sensing means for controllably varying the resistance to movement of the footrests along different portions of the first and second linear paths in response to pressure applied to the respective footrests so that the resistance is greater along portions of the first and second linear paths close to the first and second terminal points and the resistance is lower along portions of the first and second linear paths remote from the first and second terminal points to provide "step-up" so as to more closely simulate actual stair climbing.

2. The system of claim 1, wherein said variable impedance means includes:

a pair of cams each movable with a respective footrest;

a pair of switches, each selectively actuated by a respective cam in accordance with the position of the footrest along its path; and a solenoid actuated in response to actuation of said switches to provide said variable impedance.

3. The simulated stair-climbing device according to claim 1 further including a pair of hydraulic cylinders mounted to said frame, each having a piston coupled to a respective footrest, such that the pistons linearly reciprocate in response to pressure applied to the footrests;

intercylinder fluid coupling means for fluid coupling said pair of hydraulic cylinders such that the movement of one piston by its associated footrest moves the other piston in the reverse direction by action of the fluid moving in the intercylinder fluid coupling means; and a variable orifice in said intercylinder fluid coupling means to control the flow of the fluid.

4. The system of claim 3 wherein the size of said orifice is adjusted in relation to the position of at least one of the footrests so as to vary the speed of the footrests along their respective linear paths to facilitate said "step-up".

5. The simulated stair-climbing device according to claim 3, wherein said intercylinder fluid coupling means includes intercylinder fluid coupling passages for fluid coupling each side of each of the cylinders on the corresponding sides of their pistons.

6. A simulated stair-climbing device, comprising:

a frame;

a pair of footrests;

means for mounting the pair of footrests to the frame for reciprocating motion respectively along first and second, generally parallel, linear paths each path having first and second terminal points;

a pair of hydraulic cylinders mounted to said frame, each having a piston coupled to the respective footrest, such that the pistons linearly reciprocate in response to pressure applied to the footrests;

intercylinder fluid coupling means for fluid coupling said pair of hydraulic cylinders such that the movement of one piston by its associated footrest moves the other piston in the reverse direction by action of the fluid moving in the intercylinder fluid coupling means;

a variable orifice in said intercylinder fluid coupling means to control the flow of fluid;

means for sensing the position of the footrests along their respective linear paths; and variable impedance means acting in response to said position sensing means coupling to the variable orifice for controllably varying the flow in relation to the position of the footrests along their respective paths such that the speed with which the footrests move along different portions of the first and second linear paths is lower at points along the paths close to the first and second terminal points and is faster along portions of the first and second linear paths remote to the first and second terminal points to provide step-up so as to more closely simulate actual stair climbing.

7. The simulated stair-climbing device according to claim 6, wherein said intercylinder fluid coupling means includes intercylinder fluid coupling passages for fluid coupling each side of each of the cylinders on the corresponding sides of their pistons.

8. The system of claim 6, wherein said variable impedance means includes:

a pair of cams each movable with a respective footrest;

a pair of switches, each selectively actuated by a respective cam in accordance with the position of the footrest along its path; and a solenoid actuated in response to actuation of said switches to provide said variable impedance.

9. The system of claim 6, wherein said variable impedance means includes a cam controlled orifice in said hydraulic stair step control means, the size of said orifice being adjusted in relation to the position of at least one of the footrests so as to vary the speed of the footrests along their respective linear paths to facilitate said "step-up."

10. The simulated stair-climbing device according to claim 9, wherein said intercylinder fluid coupling means further includes intercylinder fluid coupling passages for fluid coupling each side of each of the cylinders on the corresponding sides of their pistons.

11. A simulated stair exercise device providing high-intensity exercise levels for providing beneficial cardiovascular exercise, comprising:

a frame;

means for mounting a pair of foot-stirrups to the frame for linear reciprocating motion respectively along first and second paths selectively inclined to the vertical in response to the user cyclically placing respective foot-stirrups in tension with the legs in such a way that respective foot-stirrups fall as the user cyclically tensions the foot-stirrups;

means for sensing the position of the foot-stirrups along their respective linear paths; and means for variably controlling the rate at which the foot-stirrups fall in relation to the position of the foot-stirrups along their respective paths such that the center of gravity of the user cyclically moves between vertically spaced positions as the user cyclically tensions the foot-stirrups thereby expanding work in lifting the center of gravity of the user through the vertical spaced positions with attendant advantages to the cardiovascular system.

12. The simulated stair-climbing device according to claim 11, further including a pair of hydraulic cylinders mounted to said frame, each having a piston coupled to the respective foot-stirrup, such that the pistons linearly reciprocate in response to tension applied to the foot-stirrups;

intercylinder fluid coupling means for fluid coupling said pair of hydraulic cylinders such that the movement of one piston by its associated foot-stirrup moves the other piston in the reverse direction by action of the fluid moving in the intercylinder fluid coupling means; and a variable orifice in said intercylinder fluid coupling means to control the flow of the fluid.

13. The system of claim 11, wherein said variable impedance means includes:

a pair of cams each movable with a respective foot-stirrup;

a pair of switches, each selectively actuated by a respective cam in accordance with the position of the foot-stirrup along its path; and a solenoid actuated in response to actuation of said switches to provide said variable impedance.

14. The system of claim 11, wherein said variable impedance means includes a cam controlled orifice in said hydraulic stair step control means, the size of said orifice being adjusted in relation to the position of at least one of the foot-stirrups so as to vary the speed of the foot-stirrups along their respective linear paths to facilitate said "step-up."

15. The system of claim 12 wherein the size of said orifice is adjusted in relation to the position of at least one of the foot-stirrups so as to vary the speed of the foot-stirrups along their respective linear paths to facilitate said "step-up."

16. A simulated stair exercise device providing high-intensity exercise levels for providing beneficial cardiovascular exercise, comprising:

a frame;

means for mounting a pair of foot-stirrups to the frame for linear reciprocating motion respectively along first and second paths selectively inclined to the vertical in response to the user cyclically placing respective foot-stirrups in tension with the legs in such a way that respective foot-stirrups fall as the user cyclically tensions the foot-stirrups, including a pair of hydraulic cylinders mounted to said frame, each having a piston coupled to the respective foor-stirrup, such that the pistons linearly reciprocate in response to pressure applied to the foot-stirrups;

intercylinder fluid coupling means for fluid coupling said pair of hydraulic cylinders such that the movement of one piston by its associated foot-stirrup moves the other piston in the reverse direction by action of fluid moving in the intercylinder fluid coupling means;

means for sensing the position of the foot-stirrups along their respective paths; and means for variably controlling the rate at which the steps fall in relation to the postion of the foot-stirrups along their respective paths such that the center of gravity of the user cyclically moves between vertically spaced positions as the user cyclically tensions the foot-stirrups thereby expending work in lifing the center of gravity of the user through the vertical spaced positions with attendant advantges ot the cardiovascular system.

17. The simulated stair-climbing device according to claim 16, wherein said intercylinder fluid coupling means further includes intercylinder fluid coupling passages for fluid coupling each side of each of the cylinders on the corresponding sides of their pistons.

18. The system of claim 16, wherein said variable impedance means includes;

a pair of cams each movable with a respective foot-stirrup;

a pair of switches, each selectively actuated by a respective cam in accordance with the position of the foot-stirrup along its path;

a solenoid actuated in response to actuation of said switches to provide said variable impedance.

19. The system of claim 16, wherein said variable impedance means includes a cam controlled orifice in said hydraulic stair step control means, the size of said orifice being adjusted in relation to the position of at least one of the foot-stirrups so as to vary the speed of the foot-stirrups along their respective linear paths to facilitate said "step-up."

* * * * *